US012139308B2

(12) United States Patent
Fischhuber

(10) Patent No.: US 12,139,308 B2
(45) Date of Patent: Nov. 12, 2024

(54) FOLDING BOX

(71) Applicant: DEPOT—PRODUKTIONS—LAGER—& HANDELS GMBH, Hornstein (AT)

(72) Inventor: Bernhard Fischhuber, Hornstein (AT)

(73) Assignee: DEPOT—PRODUKTIONS—LAGER—& HANDELS GMBH, Hornstein (AT)

( * ) Notice: Subject to any disclaimer, the term of this patent is extended or adjusted under 35 U.S.C. 154(b) by 128 days.

(21) Appl. No.: 17/784,722

(22) PCT Filed: Dec. 9, 2020

(86) PCT No.: PCT/AT2020/060440
§ 371 (c)(1),
(2) Date: Jun. 13, 2022

(87) PCT Pub. No.: WO2021/113890
PCT Pub. Date: Jun. 17, 2021

(65) Prior Publication Data

US 2023/0015782 A1 Jan. 19, 2023

(30) Foreign Application Priority Data

Dec. 13, 2019 (AT) ..... 51093/2019

(51) Int. Cl.
*B65D 5/00* (2006.01)
*B65D 5/30* (2006.01)
*B65D 5/44* (2006.01)

(52) U.S. Cl.
CPC ..... *B65D 5/002* (2013.01); *B65D 5/30* (2013.01); *B65D 5/445* (2013.01)

(58) Field of Classification Search
CPC . B65D 5/002; B65D 5/30; B65D 5/44; B65D 5/441; B65D 5/445
USPC ..... 206/600, 509, 386, 512; 229/191, 918, 229/122.21, 122.3, 179, 194–196, 199, 229/125.19, 939, 117.35, 120.11, 122.27, 229/122.31, 160, 168, 177, 185.1, 190, 229/198.2, 5.5, 919
See application file for complete search history.

(56) References Cited

U.S. PATENT DOCUMENTS 695,677 A * 3/1902 Faris ..... B65D 9/32 312/265.5
1,653,116 A * 12/1927 Parks ..... B65D 5/545 119/490

(Continued)

FOREIGN PATENT DOCUMENTS

CN 105691806 A * 6/2016
CN 205707739 U * 11/2016

(Continued)

*Primary Examiner* — J. Gregory Pickett
*Assistant Examiner* — Brijesh V. Patel
(74) *Attorney, Agent, or Firm* — Dykema Gossett PLLC

(57) ABSTRACT

The invention relates to a folding box for packaging, storing or protecting goods, having an outer shell, wherein the outer shell has at least three side walls, an upper side and a bottom side, wherein uprights are at least partially arranged at the corner edges of the side walls and wherein the side walls have connecting elements at the bottom side and/or at the upper side for connecting to the uprights, wherein the connecting elements are adapted to compensate positional tolerances and/or shape tolerances of the uprights.

24 Claims, 7 Drawing Sheets

(56) References Cited

U.S. PATENT DOCUMENTS 2,310,136 A * 2/1943 Van Wingen ..... B65D 5/446 229/199
2,775,393 A * 12/1956 Melvin ..... B65D 5/3628 229/199
3,220,633 A * 11/1965 Swane ..... B65D 9/34 206/821
3,268,147 A * 8/1966 Burger ..... B65D 5/002 229/191
3,270,943 A * 9/1966 Polenghi ..... B65D 5/0065 206/509
3,372,855 A * 3/1968 Smith ..... B65D 5/446 229/199
3,831,836 A * 8/1974 Ellison ..... B65D 5/446 229/199
3,883,067 A * 5/1975 McGlynn ..... B65D 5/22 229/179
4,211,356 A * 7/1980 Tsuchiya ..... B65D 5/5088 206/592
4,236,664 A * 12/1980 Hartelmuller ..... B65D 5/0065 229/117.16
4,266,670 A * 5/1981 Mykleby ..... B65D 5/445 217/65
5,535,941 A * 7/1996 Garza ..... B65D 5/002 229/918
6,227,442 B1 * 5/2001 Evans, Jr. ..... B65D 5/443 229/160
6,474,541 B1 * 11/2002 Chu ..... B65D 5/0045 229/196
6,640,975 B2 * 11/2003 Bennett ..... B65D 5/0025 206/509
6,817,514 B2 * 11/2004 Kanter ..... B65D 5/001 229/918
6,886,738 B2 * 5/2005 Teixidor Casanovas ..... B65D 5/0045 229/172
6,945,424 B1 * 9/2005 Gardner ..... B65D 5/326 206/83.5
7,546,927 B2 * 6/2009 Lowry ..... A47F 3/142 206/557
8,256,620 B2 * 9/2012 Kiessner ..... B65D 5/5004 229/179
8,668,133 B2 * 3/2014 Moehlig ..... 229/199
2003/0094483 A1 * 5/2003 Chu ..... B65D 5/6644 229/196
2005/0011940 A1 * 1/2005 West ..... B65D 5/445 229/199

FOREIGN PATENT DOCUMENTS

EP 1415925 A1 5/2004
FR 1319389 A 3/1963
JP H0977176 A * 3/1997
KR 200238851 Y1 * 11/2001
KR 100976392 B1 * 8/2010 ..... B65D 5/006
KR 200468026 Y1 7/2013
KR 20150087883 A * 7/2015 ..... B65D 5/44

* cited by examiner

FOLDING BOX

CROSS REFERENCE TO RELATED APPLICATION

The present application is a National Stage application of PCT patent Application No. PCT/AT2020/060440 filed on Dec. 9, 2020, which claims a priority to Austria Patent Application No. A 51093/2019 filed in on Dec. 13, 2019, disclosures of which are incorporated in their entireties by reference herein.

The invention relates to a folding box for packaging, storing or protecting goods, having an outer shell, wherein the outer shell has at least three, preferably four, side walls, an upper side and a bottom side, wherein uprights are arranged at least partially at the corner edges of the side walls and wherein the side walls have connecting elements at the bottom side and/or at the upper side for connecting to the uprights.

Such folding boxes are used both for transportation of goods of various types, but also for their storage. At the same time, these boxes can have not only protective function of the goods, but also result in their stackability. Particularly in the case of heavy goods that are stacked one on top of the other, mechanical stability and load-bearing capacity are indispensable so that several goods, which are at least partially enclosed by folding boxes. Such folding boxes can serve as disposable packaging or also as reusable packaging, i.e. they can be used repeatedly.

A folding box can thereby be brought into a substantially flat position in which it is readily stackable and transportable. In such a flat position, the side walls are at least partially superimposed. When the folding box is needed, it is unfolded, thus creating a space between the side walls. It is very advantageous if the uprights can be stored separately from the outer shell during the flat position, in order to achieve good stackability in the flat position.

Goods or stored goods in this context means products or substances of any kind, for example machines or their parts, food, etc.

In CN 205707739 U, a folding box is shown which has walls with recesses on the upper or bottom sides into which uprights can be inserted. These uprights increase the load-bearing capacity of the box and cause a weight force of an object placed on the box to be dissipated. However, this is disadvantageous as it creates openings in the folding box and the uprights can thus slip through. In addition, the uprights can fall over if they are not in engagement with the walls on both sides.

KR 20 0468026 Y1 describes a folding box in which the side walls form receptacles with tabs into which the uprights are glued. This allows a more stable connection of the uprights to the side walls. However, such a design necessitates the use of adhesives, which is disadvantageous for sensitive goods such as foodstuffs. In addition, the construction is relatively complicated, as the upright and the tab must be held in position until the adhesive has cured.

If uprights are used in the folding box, it is essential that they restrict the space inside as little as possible. In addition, it is very important that the assembly is easy and fast. If the uprights are arranged on the outer shell, preferably inside the outer shell, they can easily fall over or slide into an unfavorable position during assembly. This makes assembly more difficult. In addition, the uprights generally have a particular cross-section, which can absorb a particularly large amount of weight force in a particular position. For example, such uprights have several legs which can be at least partially movable relative to one another. If these are in an unfavorable position relative to one another, the force absorption capacity of the uprights can be reduced. Directly before or during assembly, it is therefore necessary to check whether the uprights are in their optimum position, which is time-consuming.

It is thus the object of the invention to provide a folding box of the type described, which has a high load-bearing capacity but can also be assembled easily and quickly.

According to the invention, this object is solved in that the connecting elements are adapted to compensate for positional tolerances and/or shape tolerances of the uprights.

By compensating for positional tolerances and/or shape tolerances, easier assembly can be achieved because this allows the connecting elements to move the uprights into their intended position or stance during assembly.

Positional tolerances refer to minor deviations in the position of the uprights from their intended position, which occur due to natural manufacturing and material tolerances as well as material elasticities.

Shape tolerances refer to tolerances in the shape or position of the uprights from their intended shape, which leave this shape due to internal stresses in the uprights or external forces on the uprights. In the case of L-shaped uprights made of solid board, for example, the legs may not be at an optimum 90° angle but at a smaller angle. However, this means that they can bear less load.

In this context, it can preferably be provided that at least one upright has at least two legs and the connecting elements are set up to press at least two of the legs into a defined position, preferably to press them apart.

It can be provided that at least the side walls are made of cardboard and preferably the outer shell is designed as a folding box. The cardboard can be coated, for example with PP. In this context, the coating can be on one or both sides and can be water-resistant, for example.

It may also be provided that at least the side walls, preferably the outer shell, are made of plastic, preferably of hollow-chamber web panels. Hollow-chamber web panels are plastic panels with elongated hollow chambers that extend along a longitudinal direction of the plastic panel.

It is particularly preferably provided that the connecting elements at least partially comprise receptacles in which the uprights are arranged and that the receptacles are at least partially formed by tabs of the side walls, which are connected to the tabs of the adjacent side walls via plug-in or folded connections and the uprights are inserted into the receptacles.

The term "receptacle" refers to an arrangement that limits the movement of the upright in at least one direction and thus holds it in place and presses it into a specific position and configuration. Preferably, the receptacle limits the movement of the upright in along a vertical axis in at least one direction and along a horizontal axis normal to the vertical axis in both directions. The receptacles are arranged in the region of the corner edges of the side walls and at least on the bottom side and are formed at least partially from the tabs of the side walls meeting each other.

The side walls of the folding box adjoin one another and serve, on the one hand, to protect the goods arranged in the box and, on the other hand, also to at least partially absorb weight forces. For this purpose, the side walls are preferably flat, although it may also be provided that they have recesses, for example for gripping the carton. On the sides of the side walls, which are free of further side walls, the upper side and the bottom side are arranged. If three side walls are provided, a prism-shaped folding box with triangular top and bottom is formed. If four side walls are provided, a parallelepiped can be formed. Folding boxes with more side walls, for example with eight side walls, may also be provided. This can result in octabins.

In this context, upper or lower walls can be arranged on the upper side and/or the bottom side, which additionally close the folding box and better protect the stored goods. However, it can also be provided that the upper side and/or the bottom side remain open or partially open.

It may be provided that each tab is integrally connected to at least one side wall. Alternatively, the tabs can also be glued on or attached by means of connecting elements or folded or plug-in connections.

Preferably, an upper wall is arranged at least on the upper side, which is formed at least partially from flaps of the side walls. This forms a hooded carton which is very easy to assemble and can be slipped over an item.

In this context, directional or positional indications such as top, bottom, lateral, horizontally or vertically are meant in relation to an intended position of use of the folding box, in which the upper side is arranged at the top and the bottom side at the bottom. In this context, the folding box can of course also have other positions of use, for example if the bottom side is arranged at the top and the upper side at the bottom, or a side wall is arranged at the top and the upper and bottom sides are arranged laterally.

Corner edges refer to the edges that result from the adjoining of two side walls. The uprights can be arranged inside the folding box in these, usually elongated, edge areas. Alternatively, the uprights can also be arranged outside the folding box.

Uprights are reinforcing elements which can absorb forces in at least one direction, preferably in the direction of their longitudinal extension, and thus serve to support the folding box. The uprights preferably rest against the side walls in the region of the corner edges.

The uprights can be arranged on an inner side of the side walls in the area of the corner edges. They can also be arranged on an outer side of the side walls in the area of the corner edges.

The side walls are preferably at least partially made in one piece with each other.

Plug-in or folded connections refer to connections between side walls that are created by sliding parts of the tabs inside each other, under each other, over each other or against each other, and by interlocking them.

By means of such a connection, a stable receptacle can be formed in a simple manner, which is dimensionally stable even without the provision of adhesives or other additional fastening means such as screws or staples. The receptacle can be formed first and then the upright inserted. In this context, the upright no longer needs to be held in position by adhesives or fasteners. Preferably, the connection to the upright is free of adhesives. This speeds up and facilitates assembly. In addition, the upright can be easily removed again if necessary.

In addition, the receptacles thus hold themselves independently in assembled position, with which they can be assembled and then the upright can be inserted. In addition, the receptacle can hold the position of the upright while the folding box is not yet fully assembled, which greatly facilitates handling.

It is particularly advantageous if the tabs have fastening elements comprising slots, recesses and/or tongues at least in part to form the plug-in or folded connections. This enables a stable connection which defines a defined shape or arrangement of the tabs. At the same time, however, this connection is multiple and easily detachable, enabling multiple disassembly and reassembly. In this context, tongues can be inserted into slots or recesses for this purpose. Optionally, combinations of the two can also be advantageous. Combination with other types of connection such as bonding, screwing, riveting and the like can also result in an even more stable connection.

It can further be provided that, in at least one receptacle, a first tab of a first side wall has a tongue directed towards a second tab of a second side wall and the second tab has a recess directed towards the first tab, with the shape of the recess preferably corresponding to the shape of the tongue. This allows the tabs to be bent and erected in the direction of their side walls and the tongue to be inserted into the recess, thereby preventing the backward movement of the tabs caused by restoring forces. In this way, the tabs inhibit each other's backward movement and remain in the intended position. Alternatively, a slot can be provided instead of a recess. In this case, it is important that the tongue or the recess are directed towards the second or the first side wall in an intended assembled position.

It is advantageous in this context if the tongues, slots and/or recesses face at least partially in the assembled state towards the adjacent side wall with which they form a recess. This allows optimum force to be transmitted between the fastening elements.

Preferably, the tongue has a rectangular or trapezoidal shape.

It may be provided that at least one tongue has a length which is preferably between the flap thickness and twice the flap thickness of the flap to which it connects in the assembled state. In this regard, the tongue may have an average width which is a multiple of the length of the tongue. The depth of the recess or slot is preferably equal to the length of the tongue. The width of the recess or slot preferably corresponds to the width of the tongue. Thus, a stable connection between the tabs is achieved, but at the same time parts of the tabs do not get in the way to arrange the or upright.

It is particularly advantageous if, in at least one receptacle, the first tab has at least one first tongue and at least one first recess and the second tab has at least one second recess corresponding to the shape of the first tongue and at least one second tongue corresponding to the shape of the first recess. In this case, the recesses and tongues of the first tab can be arranged along a connecting wall of the first tab, with the connecting wall facing in the direction of the second tab. In this way, a particularly stable connection can be achieved.

In order to reduce the number of parts that have to be brought together and to achieve faster assembly, it may be provided that at least some of the tabs, preferably all of the tabs, are integrally made with the side walls.

At least some of the tabs are used to form the receptacles. At least one side wall may have at least one tab in the area of each receptacle. However, in order to achieve a more stable embodiment, it is advantageous if at least some of the tabs, preferably all of the tabs, extend along the side walls substantially from one corner edge to the other. This can result in a central portion between the portions of the tab forming the receptacles. Thus, only one tab is necessary on the bottom side of each side wall, which can be used on both corner edges to form the receptacles. It may be provided that the central part is at least partially separated, for example cut off, from the parts of the tab forming the receptacles before assembly or after assembly. It may also be provided that the center portion of the folding box is completely removed.

It is also advantageous if at least one receptacle, preferably each receptacle, has at least one retaining section, and the retaining section extends essentially parallel to at least one side wall, and that at least one receptacle, preferably each receptacle, has at least one bottom section, which is arranged between the side wall and the retaining section on the bottom side and is essentially parallel to the bottom side. The bottom section may thereby prevent movement of the upright along its longitudinal axis, while the retaining section may prevent movement of the upright transversely to its longitudinal axis. Thus, in section transverse to a side wall, the receptacle preferably forms a U-shaped space into which a portion of the upright can be arranged.

Accordingly, if the receptacle is arranged on an upper side, it may also be provided that at least one receptacle, preferably each receptacle, has at least one retaining section, and the retaining section is substantially parallel to at least one side wall, and that at least one receptacle, preferably each receptacle, has at least one bottom section which is arranged between the side wall and the retaining section on the upper side and is substantially parallel to the upper side.

In order to achieve a particularly stable and firm connection, it can be provided that, in at least one receptacle, a distance D between at least one side wall and a retaining section parallel thereto corresponds to the thickness of the profile of the upright arranged therein or to the thicknesses of the profiles of the uprights arranged therein. This fixes the upright or uprights between the side wall and the retaining section, and the latter can no longer be moved along a vertical axis transverse to the longitudinal extension of the upright.

Preferably, the retaining section has a length that is at least one tenth of the length of the upright. This allows the upright to be held stably in an upright position. Preferably, the length makes up at least a quarter, more preferably at least a third of the length of the upright. Furthermore, it may be advantageous if the length is between a quarter and a third of the length of the upright.

The simplicity and rapidity of assembly can be further improved if the tabs are connected to each other exclusively by means of plug-in or folded connections.

It may be provided that at least one side wall has at least one cover flap having at least one connecting element on the upper side and/or the bottom side and that this connecting element comprises an indentation which receives at least one upright. A cover flap means a tab or flap which is arranged on a side of the side wall facing the upper side or bottom side and is designed to at least partially cover the opening of the upper side or bottom side in the assembled state. This makes it easy to implement an upper or bottom wall through parts of the side wall. In this connection, a separate notch may be provided for each upright or notches may be provided for a plurality of common uprights.

It may be provided that the notch is L-shaped, and at least one of the two legs of the notch is made thicker at its end facing away from the other leg than at at least one point between the end and its meeting point with the other leg. This allows the upright to be easily inserted and a force to move the upright to a specific position. When the cover flap is moved toward a position perpendicular to the side wall, the upright or uprights are automatically moved to their intended position. Even if the uprights are not ideally positioned beforehand and protrude into the interior of the folding box, the desired position is achieved immediately with just a few movements. At the same time, the upright is pressed into a defined configuration in the assembled position. This allows the maximum force absorption to be increased.

In this sense, it can be particularly advantageous if the inner edges of the legs or a common inner edge of the legs are curved, for example composed of several radii, or are designed as a polygonal line or lines. Polygonal line means a line having at least three portions separated by corners. In other words, the inner edge or edges is concave in shape with respect to the outer edges. This allows parts of the upright, such as legs of the upright, to be quickly received in the receptacle during assembly and simultaneously pressed into a defined position. Smaller indentations of the inner edge or edges are less of a problem here.

In the simplest case, both legs each have an outer and an inner edge. The outer edge is the edge that is located on the outside of the L-shape and the inner edge is the edge that is located on the inside of the L-shape. However, the inner edges may be curved—i.e., describe a segment of a circle or a curve, or be composed of a plurality of curves or a plurality of short straight lines—in such a way that they substantially form a common inner edge. This inner edge may also have corners or protrusions.

It can also be advantageous if at least one edge of the notch facing at least partially towards a side wall is curved or designed as a polygonal line.

For ease of manufacture, it may be provided that the folding box is made of one material, preferably except for the uprights. By dispensing with adhesives or the like for connecting the folding box and reinforcing elements, it is ensured that the folding box has no negative effects on the goods to be stored. In addition, such a design is particularly easy to dispose of and recycle since it can be easily disassembled again.

In other words, the joint is free of adhesives, staples, screws, or other parts not integrally connected to at least one of the tabs.

It is particularly advantageous if the side walls are essentially made of corrugated board. In this case, the corrugated board has at least one flat and at least one corrugated layer, which are bonded together.

It can also be advantageous if the uprights are made essentially of solid board. In this context, solid boards are understood to be boards that are single-layered, multilayered, or multilayered and solid. Alternatively, the uprights may also consist essentially of plastic, which may be fully filled or may also have hollow chambers.

The uprights can have different shapes. It is advantageous if the uprights have an L-shaped profile. This allows the legs of the upright to lie flat against the side wall and thus further stabilize the folding box.

To achieve improved stability and increased weight absorption, two uprights can be arranged along each corner edge. The uprights can, for example, be arranged one inside the other or one behind the other.

It may be provided that receptacles are provided in the area of the upper side and the bottom side. The receptacles can be designed differently.

Advantageously, therefore, it can also be a kit for assembling a folding box of the type described, with the kit having at least one outer part for forming an outer shell comprising the side walls and at least three uprights. In this case, the outer shell can first be assembled from the outer part or parts, and then the uprights can be arranged in the corresponding receptacles of the outer shell.

In the following, the present invention will be explained in more detail with reference to the embodiment variants shown in the figures, wherein:

FIG. 1*a* shows a punching pattern of a folding box according to the invention in a first embodiment;

FIG. 1*b* shows a detail from FIG. 1*a;*

FIG. 1*c* shows a part of a folding box according to a punching pattern of FIG. 1*a* and FIG. 1*b* in a cross-section transversely according to a line I-I in assembled state;

FIG. 2*a* shows a part of a partially assembled folding box according to a second embodiment in an interior view;

FIG. 2*b* shows the folding box from FIG. 2*a* in a plan view with further advanced assembly;

Figure 1A:
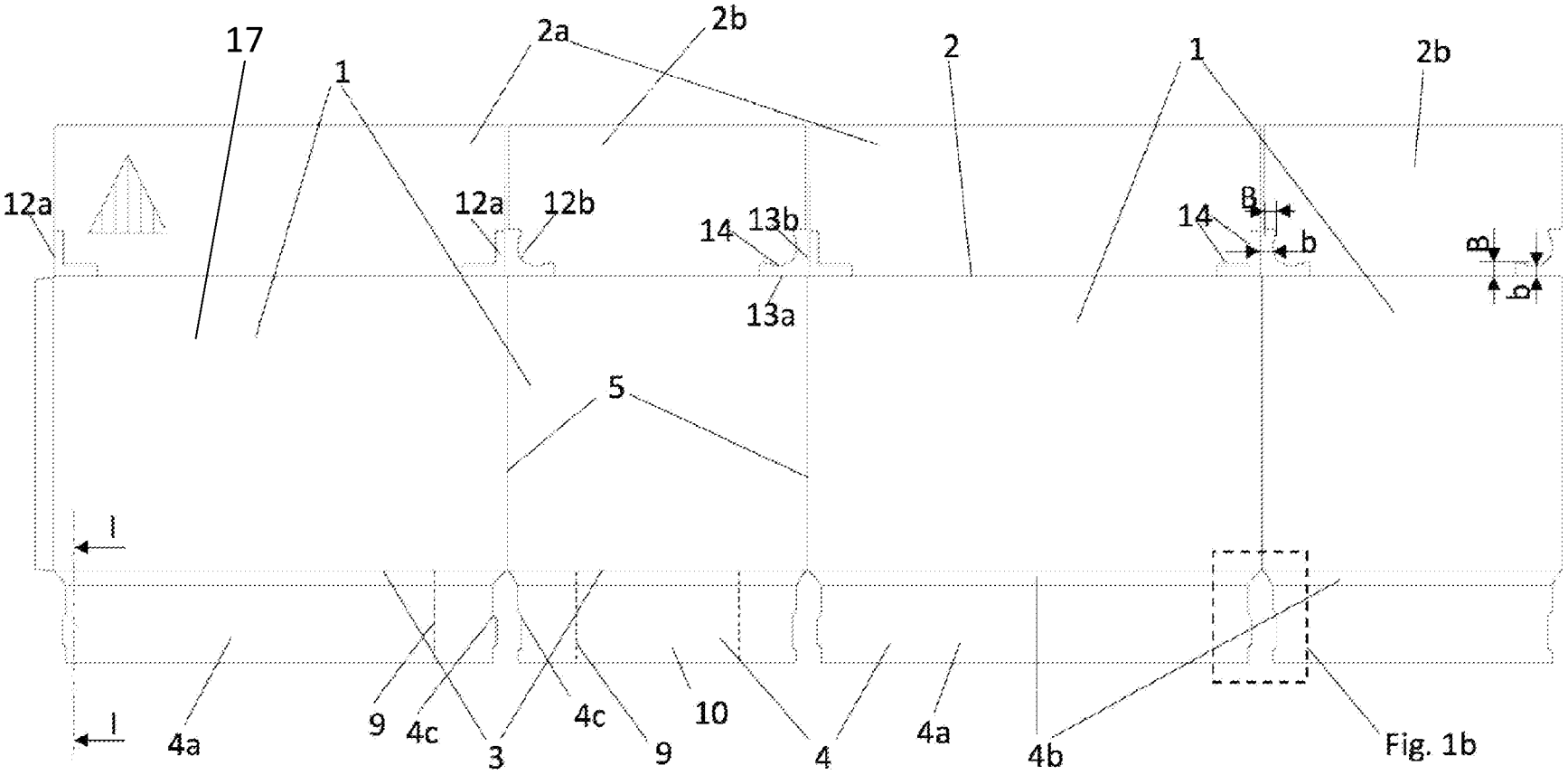
Figure 1B:
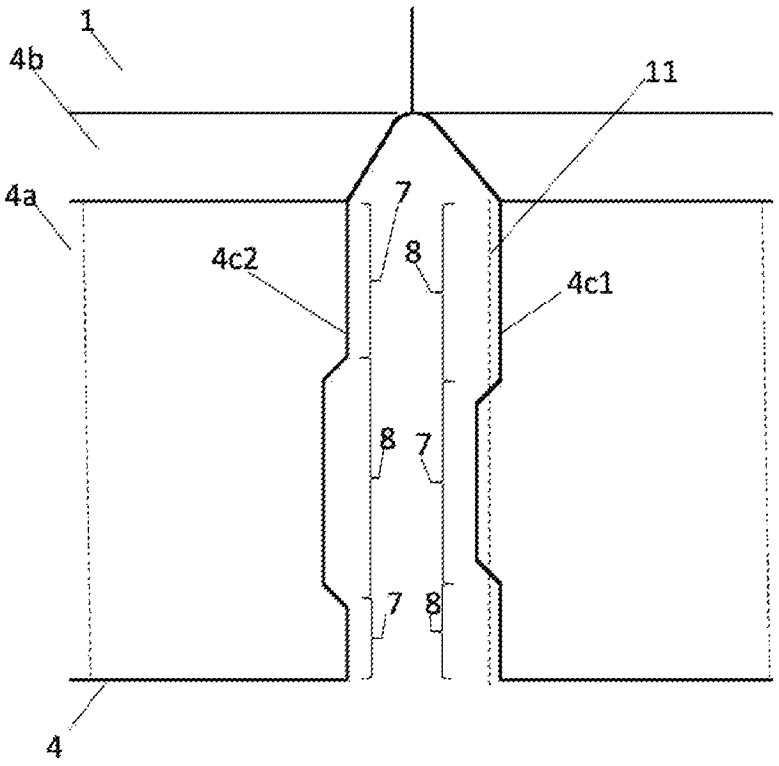

In FIG. 1*a* and FIG. 1*b*, a punching pattern of an outer part 17 for forming an outer shell of a folding box is shown, which has four rectangular side walls 1 which are made in one piece with each other. Such a punching pattern can be assembled together with four or more uprights to form a folding box, without any further auxiliary means or parts. In the assembled state, the outermost side walls 1 are brought together at their free side edges, thus forming a rectangular folding box. In this context, these side walls 1 can be glued to one another in the region of the free side edges, for example, or connected by means of screws, clips or plug-in or folded connections. In this case, all the side walls have large rectangular cover flaps 2*a* on an upper side 2, each of which extends over the entire side edges of the side walls. By folding the cover flaps 2*a* over one another, an upper wall can be formed at the upper side 2 and the folding box can be closed off at the top.

A tab 4 is arranged on the bottom side 3 at the lower edges of each side wall 1. In this case, the tabs 4 extend over the entire length of the lower edges of the side walls 1. Each tab 4 has a retaining part 4*a* and a bottom part 4*b*, with the bottom part 4*b* being arranged between the retaining part 4*a* and the side wall 1. In particular, the tabs 4 are foldable into the interior of the folding box in such a way that the bottom part 4*b* is transverse to the side walls 1 and each retaining part 4*a* is parallel to the side wall 1 to which it is connected via the bottom part 4*b*. In this way, receptacles 15 can be formed in the regions of the corner edges 5 between the side walls 1, with part of the bottom parts 4*b* acting as bottom sections and part of the retaining parts 4*a* acting as retaining sections.

The bottom parts 4*b* have a trapezoidal shape, the retaining parts 4*a* have a rectangular shape. The trapezoidal shape serves to form a substantially continuous bottom section at least in the area of the recesses.

Each tab 4 extends over the entire side edge of its side wall 1, i.e. the side wall 1 on which the tab 4 is arranged. The parts of the tabs 4 that are arranged in the area of the corner edges 5 can therefore be used to form the receptacles 15. Thus, each tab 4 is used for two adjacent receptacles 15. Thus, the tabs 4 have middle parts 10 between the adjacent receptacles 15, which can be removed completely (dashed lines 9) before or after assembly separated from the parts forming the receptacles 15.

On the connection sides 4*c* facing the adjacent tabs 4, a tongue 7 and two recesses 8 are arranged on each tab 4 on a first connection side 4*c*1 and a recess 8 and two tongues 7 are arranged on a second connection side 4*c*2. These fastening elements are arranged one behind the other along the connection sides 4*c*1, 4*c*2 and extend in total over the entire length of the connection sides 4*c*.

Starting from the bottom part 4*b*, the first connection side 4*c*1 first has a recess 8 where the first connection side 4*c*1 is set back (see center line 11). The recess 8 is followed by a tongue 7 which projects from the first connection side 4*c*1. It is followed again by a recess 8 up to the end of the first connection side 4*c*1. Here, the tongue 7 and the recesses 8 have trapezoidal shapes.

The second connection side 4*c*2 has a structure corresponding to the shape of the first connection side 4*c*1, there is a tongue 7, followed by a recess 8, followed by a tongue 7. The recess 8 of the second connection side 4*c*2 is slightly longer than the tongue 7 of the first connection side 4*c*1. Preferably, this difference is selected in accordance with the thickness of the tabs 4 so that the fastening elements can be interlocked with each other without friction.

Two cover flaps 2*a*, which are opposite each other in the assembled state, have notches 12*a* with straight edges throughout. This results in an L-shape with straight legs at an angle of 90° to each other. Each leg rests against a side wall 1 in the intended installation position. Alternatively, these two cover flaps 2*a* may have no notches 12*a*, thus forming a continuous surface at the top and preventing the uprights from slipping out.

Notches 12*b* with partially curved edges are arranged on the other cover flaps 2*b*. These notches 12*b* have outer edges 13*a*, 13*b*, with one outer edge 13*a* being positioned directly against the side wall 1 on which the cover flap 2*b* is arranged and thus facing away from it. The other outer edge 13*b* is arranged to abut and face away from an adjacent side wall 1 when assembled. This configuration is found in all of the notches 12*a*, 12*b*.

Furthermore, these notches 12*b* have inner edges 14 which face towards the side walls 1. The inner edges 14 are curved in the shape of a segment of a circle in the direction of the side walls 1, so that there are not two inner edges 14 per notch 12*b*, but only one common one. This results in a concave shape for each of the two legs.

Thus, the legs of these notches 12*b* have a first width B at their outer end regions, which is greater than the thickness of the upright 16 or uprights 16 to be arranged therein, and have a second width b in a central region of the legs, which corresponds to the thickness of the upright 16 or uprights 16 to be arranged therein.

All notches 12*a*, 12*b* are arranged in the corners of the cover flaps 2*a*, 2*b*, i.e. in the area of the corner edges 5. The cover flaps 2*a*, 2*b* are arranged in such a way that two cover flaps 2*a*, 2*b* always lie one above the other in a corner, with one cover flap 2*b* with a curved second edge 14 and one cover flap 2*a* with two straight inner edges 14 always being arranged per corner.

Figure 1C:
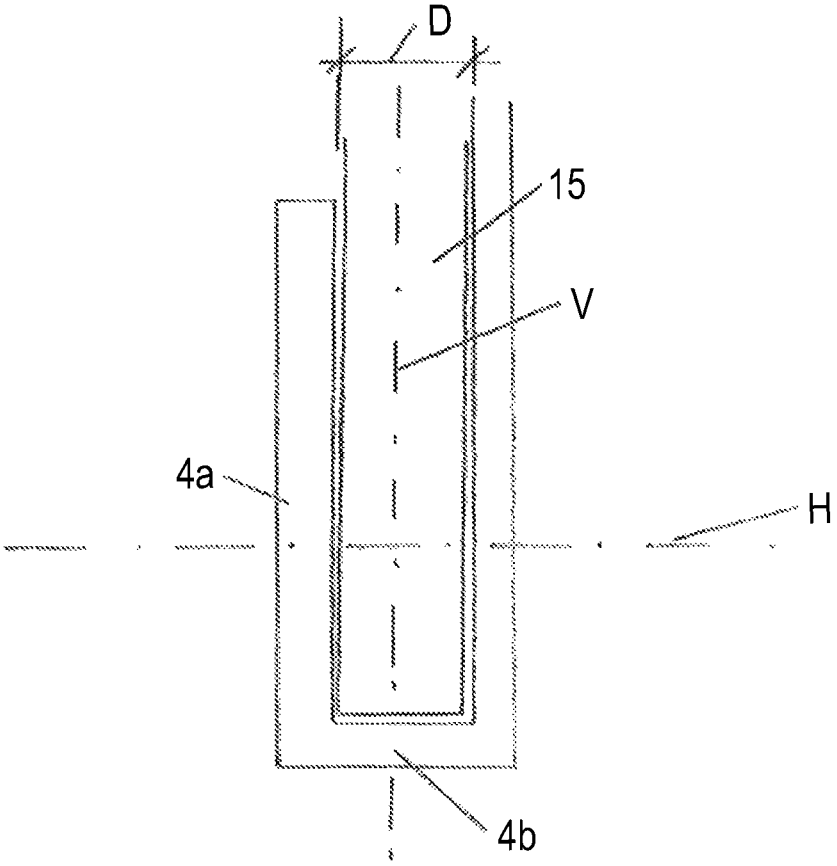

FIG. 1*c* shows a folding box which has been manufactured according to the punching pattern shown and also already at least partially assembled. A section is shown in the area of a receptacle 15 transverse to a side wall 1. Here, the tab 4 has already been folded over and the tongues 7 and recesses 8 have been folded into one another with those of the adjacent tabs 4, whereby the flap opens a U-shaped slot in which a leg of an upright 16 is arranged. Since the adjacent tab 4 has the same structure, it likewise forms a corresponding slot in the region of the receptacle 15, which can accommodate a further leg of the upright 14. In this case, the bottom part 4*b* is arranged essentially parallel to the bottom side 3 and lies parallel to a horizontal plane H. The retaining part 4*a* is essentially parallel to the side wall 1 and to a vertical plane V. Thus, the receptacle 15 has a distance D between the side wall 1 and the retaining part 4*a* which preferably corresponds to the thickness of the upright 16 or the thicknesses of the uprights 16 which are to be arranged therein.

Thus, the parts of the bottom parts 4*b* of the adjacent tabs 4, which are arranged in the area of the receptacle 15, jointly form the bottom section. Correspondingly, the parts of the retaining parts 4*a* of the adjacent tabs 4, which are arranged in the area of the receptacle 15, also jointly form the retaining section.

Figure 2A:
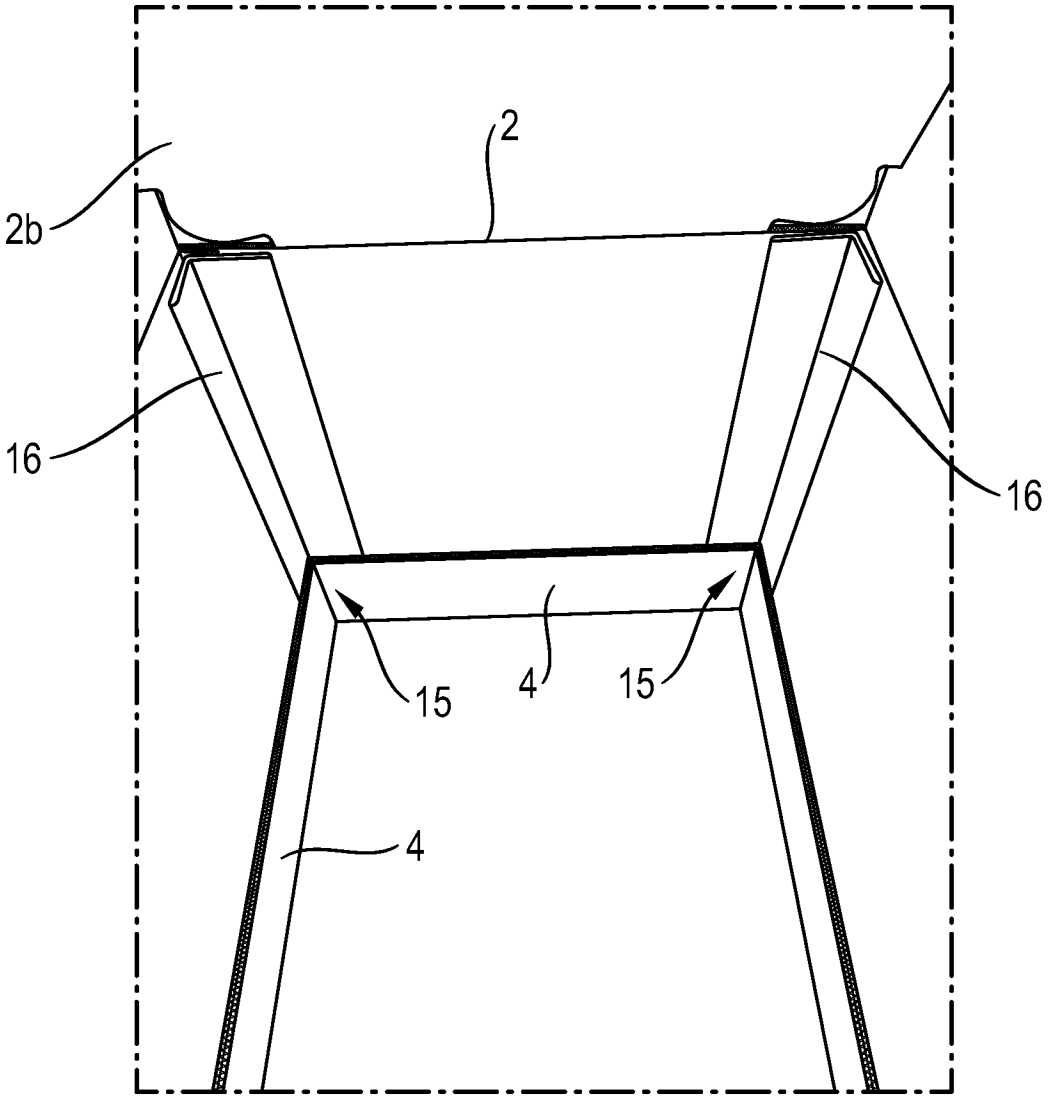

FIG. 2*a* shows a second embodiment in an assembled state. The tabs 4 are formed as in the first embodiment and are folded inward in the state shown. The tongues 7 of the first and second connecting sides 4*c*1, 4*c*2 are engaged with the respective recesses 8, whereby the folded shape stabilizes itself. This results in openings along the side walls 1 with a thickness D defined by the width of the bottom parts 4*b*. In the areas of the corner edges 5 there are thus recesses 15 which have an L-shape.

In these receptacles 15, uprights 16 are inserted, which have an L-shaped profile corresponding to the receptacles 15 and extend from the receptacles 15 on the inside of the corner edges 5 to the upper side 2.

Figure 2B:
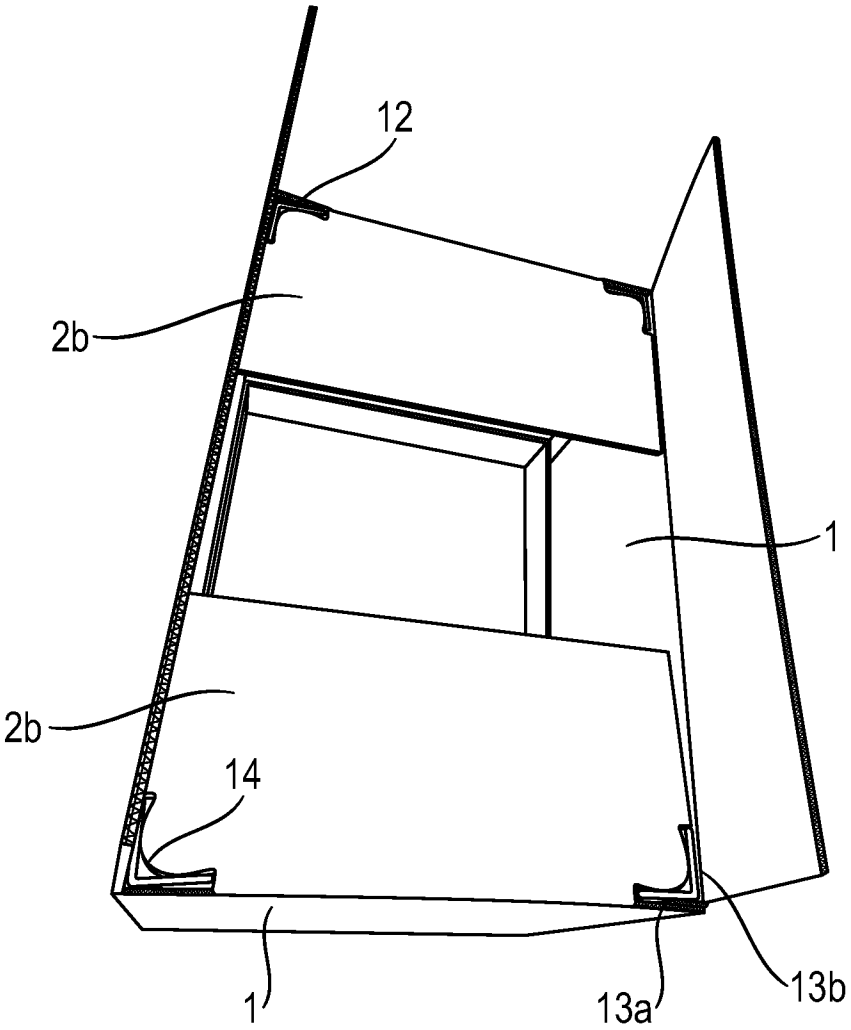

The cover flaps 2 *a*, 2 *b* are shown opened for better viewing. They are designed as in FIG. 1 *a*, but only two opposite cover flaps have notches 12 with curved inner edges 14. In the assembled state, these cover flaps 2 *b* are first folded onto the side walls 1, with the uprights 16 penetrating the notches 13 at their upper sides and being held in place by them. FIG. 2 *b* shows such a configuration. Here, the curved shape of the inner edges 14 pushes the legs of the uprights 16 apart and stabilizes them in this position. The remaining cover flaps 2 *a* are subsequently folded and thus close the upper side without gaps except for a gap in the center which may occur.

Except for the uprights 16, the folding box is made of corrugated board and in one piece, with the uprights 16 being made of solid board. Alternatively, the folding box can also have an outer shell which is in two pieces.

Figure 3:
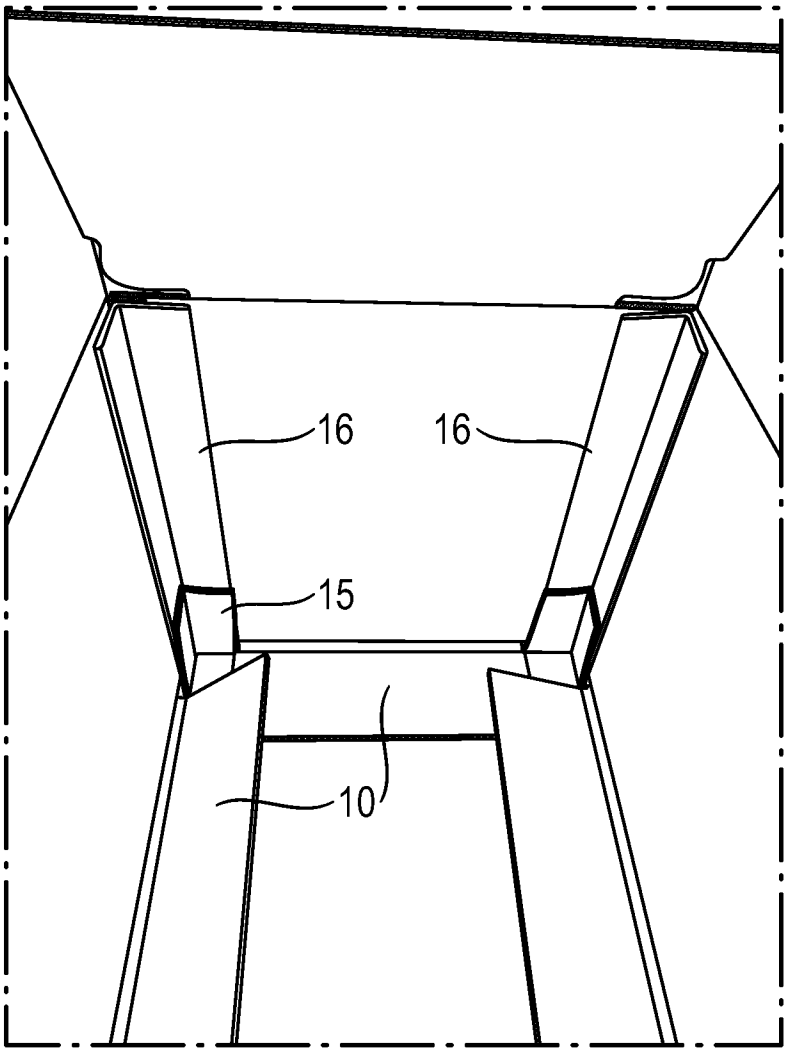
FIG. 3 shows a part of a partially assembled folding box according to a third embodiment in an interior view.

FIG. 3 shows an alternative embodiment in which the same punching pattern from the second embodiment was used. However, before folding the tabs 4, the center parts 10 were separated from the parts of the retaining part 4*a* forming the receptacles 15.

Figure 4:
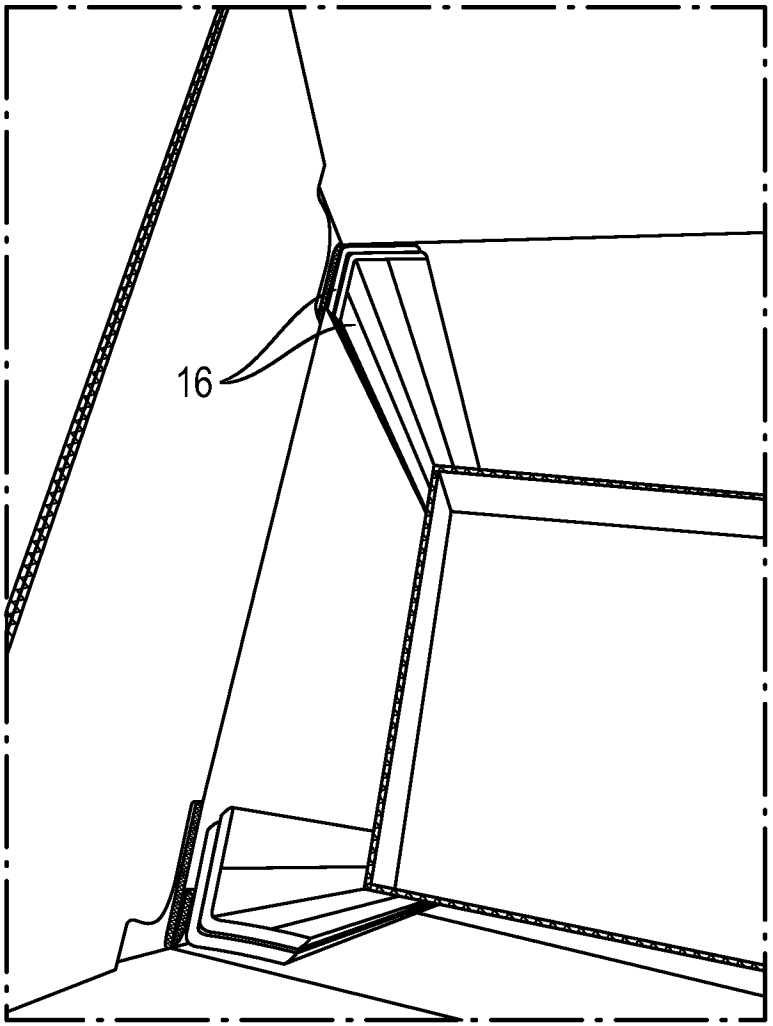
FIG. 4 shows a part of a partially assembled folding box according to a fourth embodiment in an interior view.

FIG. 4 shows a further embodiment which largely corresponds to the second embodiment. However, the bottom part 4*b* has been made longer so that two uprights 16 can be inserted into each receptacle 15. For this purpose, the uprights are arranged one behind the other. Accordingly, the notches 13 should also be made larger.

The invention claimed is:

1. A folding box for packaging, storing or protecting goods, the folding box including an outer shell, wherein the outer shell includes at least three side walls, an upper side and a bottom side, wherein uprights are at least partially arranged at the corner edges of the at least three side walls and wherein the at least three side walls include connecting elements at the bottom side or at the upper side and the connecting elements are configured and arranged to connect to the uprights, wherein tabs are arranged on the bottom side at the lower edges of the at least three side walls, wherein the connecting elements are configured and arranged to compensate for positional tolerances or shape tolerances of the uprights, the connecting elements at least partially comprise receptacles in which the uprights are arranged, and wherein the receptacles are at least partially formed by the tabs of the at least three side walls, which are connected to the tabs of the adjacent side walls of the at least three side walls via plug-in or folded connections, and the uprights are inserted into the receptacles.

2. The folding box according to claim 1, wherein the at least three side walls are made of cardboard.

3. The folding box according to claim 1, wherein the at least three side walls are made of plastic, of hollow-chamber web panels.

4. The folding box according to claim 1, wherein the tabs include fastening elements comprising at least partially slots, recesses or tongues configured and arranged to form the plug-in or folded connections.

5. The folding box according to claim 4, wherein the shape of the recess corresponds to the shape of the tongue.

6. The folding box according to claim 1, wherein in at least one receptacle, a first tab of a first side wall of the at least three side walls includes a tongue directed towards a second tab of a second side wall and the second tab includes a recess directed towards the first tab.

7. The folding box according to claim 6, wherein in the at least one receptacle the first tab includes at least one first tongue and at least one first recess and the second tab has at least one second recess corresponding to the shape of the at least one first tongue and at least one second tongue corresponding to the shape of the at least one first recess.

8. The folding box according to claim 1, wherein at least some of the tabs, are made in one piece with the at least three side walls.

9. The folding box according to claim 1, wherein at least part of the tabs, extend along the at least three side walls from one corner edge to the other.

10. The folding box according to claim 1, wherein at least one receptacle includes at least one retaining section, and the at least one retaining section is parallel to at least one side wall, and in that at least one receptacle has at least one bottom section, which is arranged between the at least one side wall and the at least one retaining section at the bottom side and is parallel to the bottom side.

11. The folding box according to claim 10, wherein in at least one receptacle, a distance (D) between the at least one side wall and a retaining section of the at least one retaining section parallel thereto corresponds to the thickness of the profile of the upright arranged therein or to the thicknesses of the profiles of the uprights arranged therein.

12. The folding box according to claim 1, wherein the connection of the tabs to one another is effected exclusively via plug-in or folded connections.

13. The folding box according to claim 1, wherein the folding box is made of one material.

14. The folding box according to claim 1, wherein the at least three side walls are made of corrugated board.

15. The folding box according to claim 1, wherein the uprights are made of solid board.

16. The folding box according to claim 1, wherein the uprights have an L-shaped profile.

17. The folding box according to claim 1, wherein two uprights are arranged along each corner edge.

18. The folding box according to claim 1, wherein the outer shell includes four side walls.

19. The folding box according to claim 1, wherein the outer shell is designed as folding cardboard.

20. The folding box according to claim 1, wherein at least the at least three side walls, are made of hollow-chamber web panels.

21. A folding box for packaging, storing or protecting goods, the folding box comprising:

an outer shell, wherein the outer shell includes at least three, side walls, an upper side and a bottom side, wherein uprights are at least partially arranged at the corner edges of the at least three side walls and wherein the at least three side walls include connecting elements at the bottom side or at the upper side and the connecting elements are configured and arranged to connect to the uprights, wherein the connecting elements are configured and arranged to compensate for positional tolerances or shape tolerances of the uprights, wherein at least one side wall includes, on the upper side or the bottom side, at least one cover flap, the at least one cover flap including at least one connecting element, and wherein this connecting element comprises a notch which accommodates at least one upright.

22. The folding box according to claim 21, wherein the notch is L-shaped, and at least one of two legs of the notch is made thicker at this leg's end facing away from the other leg than at least one point between the end and its meeting point with the other leg.

23. The folding box according to claim 22, wherein the inner edges of the legs or a common inner edge of the legs are or is curved or designed as a polygonal line or lines.

24. The folding box according to one of claim 21, wherein at least one edge of the notch facing at least partially towards a side wall is curved or designed as a polygonal line.

* * * * *